US010515509B2

(12) United States Patent
Fridrich

(10) Patent No.: US 10,515,509 B2
(45) Date of Patent: Dec. 24, 2019

(54) GAMING DEVICE COMPRISING A ROTATABLE GAME WHEEL

(71) Applicant: NOVOMATIC AG, Gumpoldskirchen (AT)

(72) Inventor: Heinz Fridrich, Gumpoldskirchen (AT)

(73) Assignee: Novomatic AG, Gumpoldskirchen (AT)

( * ) Notice: Subject to any disclaimer, the term of this patent is extended or adjusted under 35 U.S.C. 154(b) by 393 days.

(21) Appl. No.: 15/389,876

(22) Filed: Dec. 23, 2016

(65) Prior Publication Data

US 2017/0109961 A1 Apr. 20, 2017

Related U.S. Application Data

(63) Continuation of application No. PCT/EP2015/064229, filed on Jun. 24, 2015.

(30) Foreign Application Priority Data

Jun. 27, 2014 (DE) ..... 20 2014 005369 U

(51) Int. Cl.
*G07F 17/32* (2006.01)

(52) U.S. Cl.
CPC ..... *G07F 17/3211* (2013.01); *G07F 17/329* (2013.01); *G07F 17/3209* (2013.01)

(58) Field of Classification Search
CPC ..... G07F 17/3211; G07F 17/3209
See application file for complete search history.

(56) References Cited

U.S. PATENT DOCUMENTS

| | | | | |
|---|---|---|---|---|
| 5,947,820 | A | 9/1999 | Morro et al. | |
| 6,105,962 | A * | 8/2000 | Malavazos | G07F 17/3202 273/138.1 |
| 6,988,731 | B2 * | 1/2006 | Inoue | G07F 17/3211 273/138.2 |
| 7,241,220 | B2 * | 7/2007 | Rothkranz | G07F 17/3202 463/18 |
| 7,540,806 | B2 * | 6/2009 | Tastad | A63F 13/08 16/324 |
| 7,566,269 | B2 * | 7/2009 | B-Jensen | G07F 17/3202 273/138.1 |
| 7,614,952 | B2 * | 11/2009 | Elias | G07F 17/3211 463/20 |
| 7,651,392 | B2 * | 1/2010 | Pennington | G07F 17/3267 463/16 |
| 7,731,580 | B2 * | 6/2010 | Rothkranz | G07F 17/3211 273/143 R |

(Continued)

FOREIGN PATENT DOCUMENTS

| | | |
|---|---|---|
| AT | 19 53 06 B | 1/1958 |
| DE | 36 32 203 A1 | 3/1988 |

(Continued)

*Primary Examiner* — James S. McClellan
*Assistant Examiner* — Kevin M Carter
(74) *Attorney, Agent, or Firm* — EIP US LLP

(57) ABSTRACT

A gaming device comprising a game wheel for obtaining a result of the game, said game wheel being mounted so as to be rotatable about a wheel axis. An electronically actuated screen associated with the game wheel viewed in the viewing direction of the wheel axis. The screen is placed in front of the game wheel and covers part of a game wheel surface which faces a location for operating the gaming device.

13 Claims, 3 Drawing Sheets

(56) References Cited

U.S. PATENT DOCUMENTS

| | | | | |
|---|---|---|---|---|
| 7,762,883 | B2 * | 7/2010 | Griswold | A63F 5/00 273/138.2 |
| 8,517,382 | B1 * | 8/2013 | Pagliuca | G07F 17/3202 273/142 E |
| 8,956,216 | B1 * | 2/2015 | LeSourd | G07F 17/3213 463/20 |
| 2003/0064799 | A1 * | 4/2003 | Goins | G07F 17/3211 463/30 |
| 2004/0018866 | A1 * | 1/2004 | Inoue | G07F 17/3213 463/16 |
| 2004/0150161 | A1 * | 8/2004 | Inoue | G07F 17/3211 273/292 |
| 2004/0171417 | A1 * | 9/2004 | Beaulieu | G07F 17/3211 463/20 |
| 2007/0054723 | A1 * | 3/2007 | Mattice | G07F 17/32 463/16 |
| 2007/0054727 | A1 * | 3/2007 | Garamendi | G07F 17/3211 463/16 |
| 2008/0227530 | A1 * | 9/2008 | LeMay | G07F 17/3202 463/22 |
| 2008/0277869 | A1 * | 11/2008 | Wu | A63F 5/045 273/142 R |
| 2009/0111577 | A1 * | 4/2009 | Mead | G07F 17/3211 463/31 |
| 2011/0118013 | A1 * | 5/2011 | Mattice | G07F 17/3202 463/30 |
| 2011/0312401 | A1 * | 12/2011 | Griswold | G07F 17/3202 463/20 |
| 2013/0217458 | A1 * | 8/2013 | LeSourd | G07F 17/34 463/16 |
| 2014/0194182 | A1 * | 7/2014 | Young | G07F 17/3213 463/20 |

FOREIGN PATENT DOCUMENTS

| | | | |
|---|---|---|---|
| DE | 10 2008 027308 | A1 | 12/2009 |
| DE | 202012012114 | U1 | 4/2013 |
| EP | 2 618 316 | A1 | 7/2013 |
| WO | 2014/073722 | A1 | 5/2014 |

* cited by examiner

GAMING DEVICE COMPRISING A ROTATABLE GAME WHEEL

CROSS-REFERENCE TO RELATED APPLICATIONS

This application is a continuation under 35 U.S.C. § 120 of PCT Application No. PCT/EP2015/064229, filed Jun. 24, 2015, which claims priority to DE Patent Application No. DE 202014005369.3, filed Jun. 27, 2014. The entire contents of each of the aforementioned applications are hereby incorporated by reference.

BACKGROUND OF THE INVENTION

The present disclosure relates to a gaming device with a game wheel rotatably mounted around a wheel axis for playing a score.

Gaming devices are known as, for example so-called wheels of fortune, usually having a wheel rotatable around a fixed axis, on which markings are applied that divide the front surface of the wheel into several sectors. The individual sectors form so-called luck or winning fields. On the outer edge of the wheel, protruding abutment elements, such as, for example metal pins can be mounted between the markings from the surface of the wheel. A flexible engagement element, for example in the form of a rubber tab or a spring flap engages in the areas between the abutment elements and marks a specific winning field.

Such wheels of fortune can be rotated either manually or motorized, whereby the wheel can rotate along the fixed mounted engagement element, which can be pushed over the abutment elements due to its flexible design or bearing. After a certain time of rotation, the wheel remains in a random position and the engagement element marks one of the winning fields, namely, the one which comes to rest on the engagement element so that the engagement element can engage the laterally limiting abutment elements.

Such a wheel of fortune is known, for example from document DE 202012012114 U1, which proposes to apply light beams to the wheel of fortune, the light beams being projected onto an extensive projection surface, for example a hall wall, to make the game more visible to a wider audience. However, such mounting of light beams on the wheel of fortune requires large installation spaces to really enable effective perception. In addition, the area between the wheel of fortune and the projection screen must not be obstructed by persons or other gaming devices, since this would prevent light projection. That, in turn means that the wheel of fortune can hardly be directly observed by any player in the close range.

A rotatably mounted, driven wheel of fortune is also known from document AT 19 53 06, in which the rotatable wheel is accommodated in a box-shaped housing, the front plate of which is to consist of a transparent plastic on which adornments such as, for example painted figures can be attached. The drive of the wheel of fortune is carried out by means of an electric motor, wherein a roller or a brake which can be driven by the electric motor can be selectively brought into engagement with the wheel of fortune by means of a manually operable rocker.

The document DE 36 32 203 A1 also shows a wheel of fortune, which on its front side has several rings of different fields of luck which are intended to be used for various competitions or games such as lotto and toto.

However, the information, markings or even embellishments that can be attached to the game wheel are limited because of the limited size of the wheel of fortune, which ultimately should have humanly manageable dimensions. Previous wheels of fortune rely on an intuitive understanding of the game mechanism. Furthermore, due to the simple mechanical principle, at least in the case of repeated play, the score is no longer completely accidental, since even with the aid of an electromotive drive a prediction can be made as to how far the wheel of fortune runs and at what point it will stop when the drive is switched off.

SUMMARY

The present disclosure is therefore based on the object of providing an improved gaming device of the type mentioned at the outset, which avoids the disadvantages of the state of the art but rather advantageously develops it. Particularly, a more complex mediation of relevant game information and a better interaction between the player and the gaming device should be made possible while, on the other hand, an improved manipulation protection should be provided as well.

It is therefore proposed to combine the mechanical game wheel with an electronically controllable screen so that, on the one hand, the archaic charm of the mechanics of the actual rotatable and stopping game wheel is maintained, while on the other hand the variable character, image and/or letter and/or the complex game information can be displayed and the interaction with the player is improved. According to one embodiment, the gaming device is distinguished by an electronically controllable screen, which is assigned to the game wheel and is mounted at least partially within the circumferential contour of the game wheel as viewed in the viewing direction of the wheel axis. In this case, the screen can advantageously be superimposed to the game wheel—that is, say when the front face of the game wheel is correctly viewed from a user or user location of the gaming device according to the invention, the screen is located in front of a part of the body of the game wheel. A part of the playing wheel body or a part of a game surface facing the operator control console of the gaming device is concealed by the screen set before.

Such mounting, at least partially within the user-facing viewing side of the game wheel, allows an ergonomically favorable, fatigue-free operation, whereby both the screen and the game wheel and its possibly revolving sectors can be simultaneously viewed without the head being rotated back and forth for this purpose. Such mounting of the screen surface and the game wheel surface lying at least partially, or at least partially overlaying, is at least partially based on the consideration that at least the outer edge region is, so far, largely considered in the case of backlashes, particularly when a compliant engagement element engages in corresponding wheel segments between abutment elements, wherein the inner and central area of the game wheel is usually given less attention.

In an advantageous development of one embodiment, the screen can be mounted fixed so that the game wheel rotates relative to the screen, at least a part of the game wheel can rotate around the screen. The mounting of the screen is at least rotatably fixable in a specific position. The screen can basically be mounted in variable positions, for example to be tilted in the case of light mirroring or an extraordinary size of the device user, or can be moved, for example as a function of a player's score and/or a game function to win by a screen movement, for example by a to-and-fro screen movement. In a further development of the invention, however, the screen can also be mounted completely fixed, for example on a bearing element, on which the game wheel is rotatably mounted, or a support part or a housing part connected thereto, for example a game wheel housing enclosing the game wheel.

In a further development of one embodiment, the screen can be mounted completely within the circumferential contour of the game wheel so that on the respective side of the screen a part or sector of the game wheel is visible or an edge section of the game wheel remains completely visible, while an inner partial section of the game wheel stays concealed behind the screen.

Particularly, the screen can be centered to the wheel axis of the game wheel. Such a centered mounting allows for a compact, centralized bearing of both the game wheel and the screen. Additionally, the screen can have a large area screen surface without concealing too much of the game wheel.

In a development of one embodiment, the screen can be aligned with its screen surface at least approximately parallel to the plane of rotation of the game wheel or at least approximately perpendicular to the wheel axis.

With a further development of another embodiment, the wheel body of the game wheel can be plate-shaped or disc-shaped and set back in the direction of the wheel axis in relation to the screen surface of the screen. In case of such a disc-shaped wheel body, the edge section of the game wheel located laterally outside the screen also extends a distance in the wheel axis direction behind the screen.

Alternatively, in another embodiment, the game wheel can also have a generally approximately soup-plate-shaped wheel body with a tub- or cup-shaped deepening, in which deepening the screen can at least partially be recessed. In this case, a wheel body rim which encompasses the said cup-shaped deepening, which protrudes towards the intended user location of the gaming device to the bottom of the deepening, can, at least approximately lie in a plane with the display surface.

The central section of the game wheel concealed from the screen set before can be provided with a full-surface or plate-like design, but can also be embodied in a spoke-like manner or can be composed of struts. The edge portions of the game wheel body, which are visible on the side next to the screen can, on the other hand, advantageously be formed in a closed-surface or plate-like manner.

The game wheel can basically be manually driven or rotated.

Alternatively, or additionally, a motorized drive may be provided, for example in the form of an electric drive for rotationally driving the game wheel, which drive may be connected to a control device to be able to switch off the drive, for example by pressing a button or a random number generator.

Alternatively, or additionally, a brake, which may also be randomly controlled and/or manually operated, may be provided for decelerating the game wheel rotation.

The power and signal supply of the screen can basically be accomplished in various ways. To avoid hanging cables extending in front of the game wheel, for example grinding contacts could be provided for the signal and/or power supply of the screen over the rotating game wheel. In a further development of one embodiment however, a signal line and/or a power supply line can be led to the screen through a hollow wheel axis of the game wheel. The rotatable support of the game wheel may have a central cable gland shaft or channel through which signal and power supply cables can be routed from a rear side of the game wheel to the screen set before the front of the game wheel.

To enable a further improved interaction between the device operator and the gaming device, the screen can be designed as a touchscreen or touch panel, which can be connected to a control device for controlling at least one game wheel function, particularly such that by touching the screen and/or by approaching the screen said at least one game function can be controlled. As known, the touchscreen can detect an actual contact by a body member, for example, a finger is placed on the screen, whereby, for example resistance changes can be detected on the screen surface due to such contact with a suitable sensor system. Alternatively, or additionally to the actual touching, the touchscreen can however also operate with a sensor system which already detects an approach of a body member, such as a finger to the screen surface, for example optical sensors or other non-contact sensor systems.

For example, a control panel for starting and/or stopping the game wheel rotation may be provided on the screen designed as a touchscreen, for example in the form of a start/stop button which, for example may be shown in different colors, depending on the function. For example, a green button-like operating surface can serve as a start button and/or a red button-like operating surface can serve as a stop button.

Alternatively, or additionally to such a colored control panel design, letter or numerical characters or picture representations, such as pictograms can also be combined with the control panels or the control panels themselves can be embodied in the form of symbols, such as arrows.

To increase the tamper protection or to eliminate the predictability of the game wheel rotation, the control device can implement the control commands given on the touchscreen indirectly, for example with the interposition of a random-controlled timer or time-offset member. A key press or control panel key actuation merely activates a random generator, which then activates the game wheel function, for example deceleration, acceleration or the like, operating unpredictably.

Alternatively, or additionally, to an operating element which is designed in the manner of an on/off switch only in one dimension, it is also possible to have at least one swipe area for controlling at least one game wheel function by swiping the screen designed as a touchscreen. Such a swipe area can, for example, be designed in such a way that it does not react to mere touch, but instead generates a control command only when a body member is swept across the screen and a corresponding swiping is detected.

By means of such a swipe function, basically different game wheel functions can be controlled, for example also the start and/or stop functions, wherein in this case, additional manipulation safety can already be achieved by the swiping, since such swipe motions can generally not be motor-controlled as precisely as a mere touch.

The swipe area actuation can be implemented directly in a corresponding control command or, according to the said explanation, a random-number-generator-controlled control of the respective function can be started.

In a further development of one embodiment, it is also possible particularly to control direction-dependent and/or speed-dependent game wheel functions, for example the direction of rotation of the game wheel and/or the rotational speed of the game wheel, by means of such a swipe area on the touchscreen. For example, swiping on a swipe area in a first direction, for example from left to right, the game wheel can be rotated clockwise. If, however, the swiping on the swipe area is the opposite, second swiping, for example from right to left, the game wheel can be rotated counterclockwise.

In a further development of one embodiment, such a rotation-controlling swipe field can be represented in the form of a direction-of-rotation symbol, for example in the form of a direction-of-rotation arrow. Alternatively, or additionally, such a rotation-controlling swipe field can also be assigned locally to the game wheel in such a way that a swipe direction corresponds to the direction of rotation of the game wheel section lying beneath the swipe area. If, for example, a swipe area, lying between 11 o'clock and 1 o'clock above the wheel axis is displayed on the screen, a clockwise swiping of 11 o'clock after 1 o'clock and a reverse swiping of 1 o'clock after 11 o'clock can result in a counterclockwise rotation of the game wheel to be implemented.

Alternatively, or additionally, to such a rotational direction-controlling configuration of the swipe area, a speed-controlling function can also be assigned to this or another swipe area which is displayed on the screen.

By means of a sensor system, which is assigned to the swipe area, the touchscreen can detect the speed and/or distance of the swiping. For example such a system may detect the swipe of a finger on the screen and control the rotational speed of the game wheel as a function of the detected swiping speed. In some embodiments, a faster and/or a wider swiping, e.g. a swiping guided over a longer distance, is converted into a faster play wheel rotation, while a slower or shorter swiping is converted into a less rapid rotational movement of the game wheel.

Additional understanding of the systems and configurations contemplated and/or claimed by the inventor can be gained by reviewing the detailed description of exemplary embodiments, presented below, and the referenced drawings.

DETAILED DESCRIPTION OF CERTAIN INVENTIVE EMBODIMENTS

Figure 1:
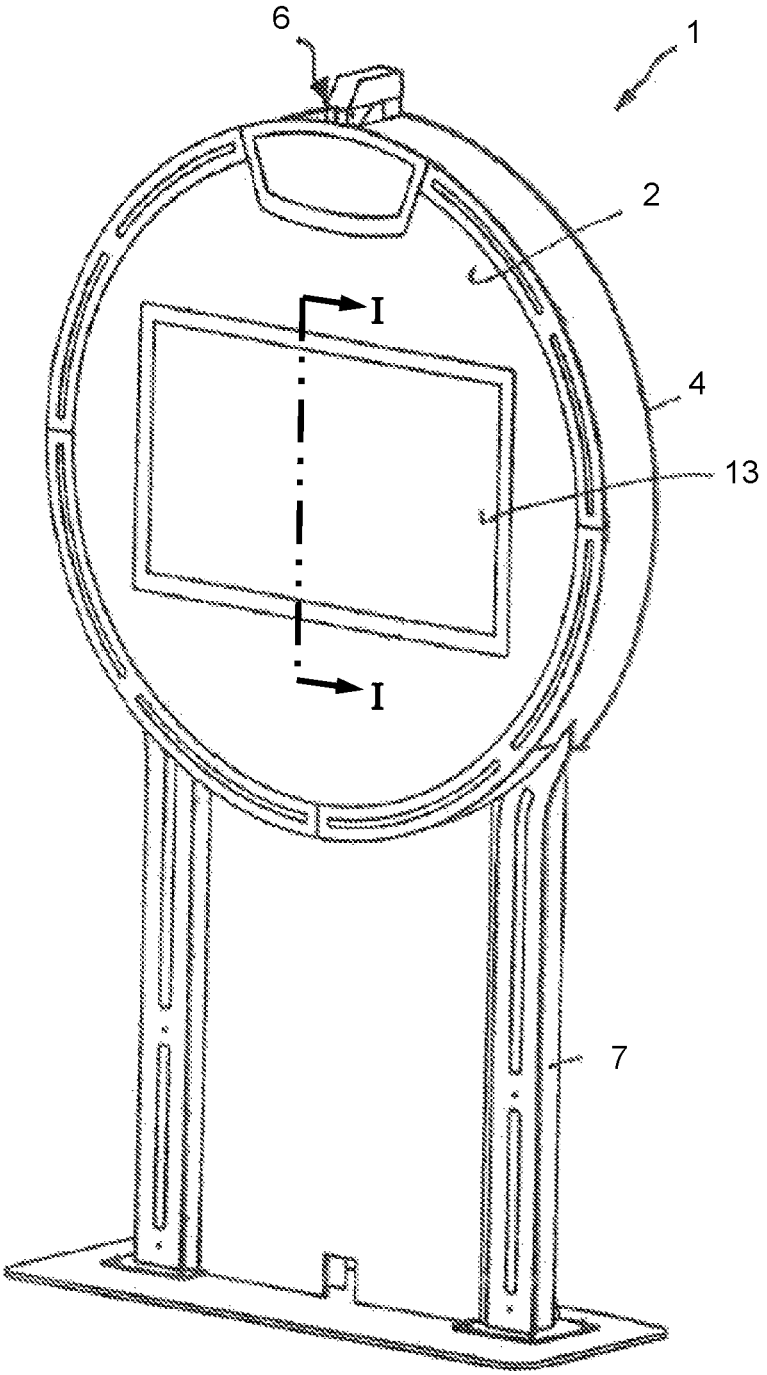
FIG. 1: A schematic perspective view of a gaming device obliquely from the front, wherein a screen is provided for a game wheel rotatable about a lying wheel axis.
Figure 2:
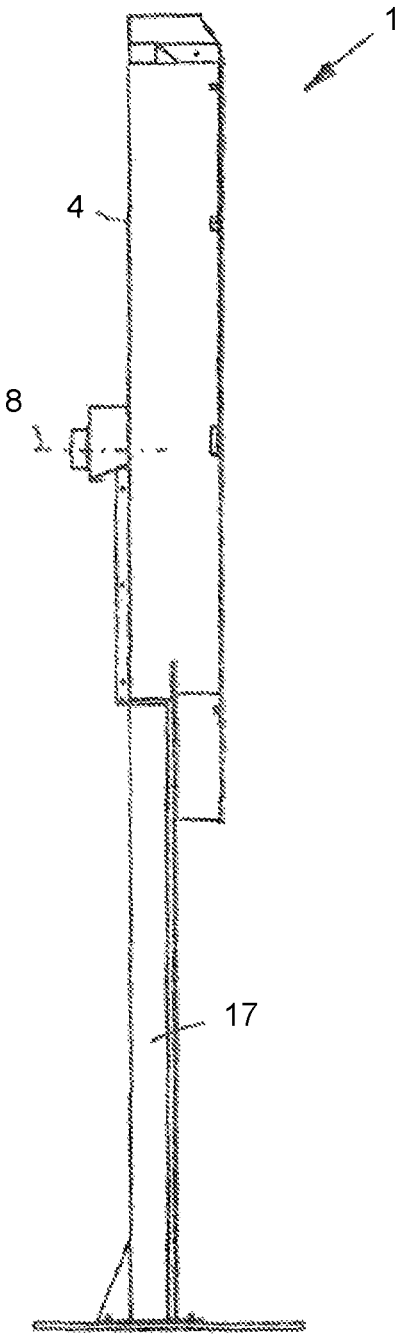
FIG. 2: A side view of the gaming device from FIG. 1 in a viewing direction perpendicular to the wheel axis of the game wheel.

As shown in FIGS. 1 and 2, the gaming device 1 may comprise a game wheel 2, which is at least approximately horizontally fixed, which is rotatably mounted around a lying wheel axis 8, as explained below. The game wheel 2 can thereby be accommodated within a game wheel housing 4, which can be provided on the front side with a transparent housing disc to allow the view of the game wheel 2 lying behind it.

Alternatively however, the game wheel 2 can also be mounted at least partially free-lying or free-standing or without a housing.

Figure 3:
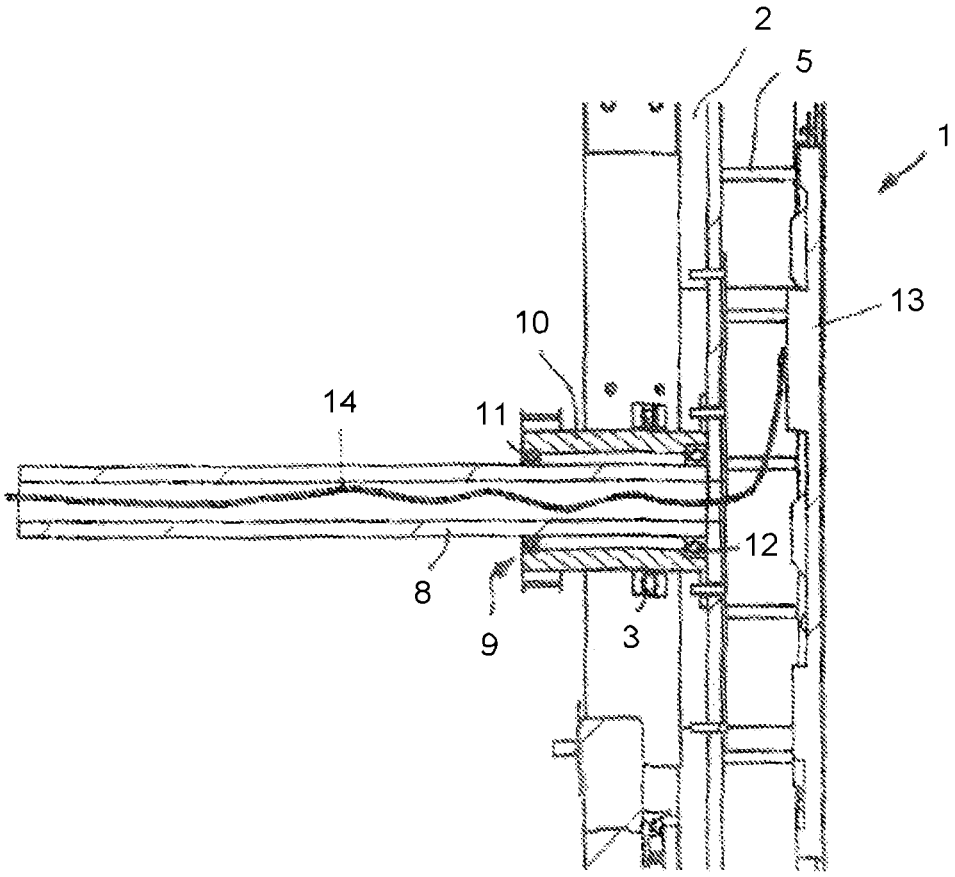
FIG. 3: A sectional view, generally along Sectional Line I of FIG. 1, through the wheel axis of the game wheel showing the rotatable support of the game wheel and the cabling of the screen set in front of the game wheel through the hollow wheel axis.

The game wheel 2 may have a disc or plate-shaped wheel body, on the front side of which, as known, markings can be applied, for example printed, particularly in the form of different playing field or winning field sectors, between which, abutment elements 5, for example in the form of projecting pins may be provided on an edge section of the game wheel 2, as shown in FIG. 3.

For example, on an upper segment of the circulating track of the game wheel 2, an engagement element 6, which is interposed between the said abutment elements 5, for example a flexible or movably mounted and/or spring-loaded engagement element 6, can be provided on which the game wheel passes. Said engagement element 6 then falls between two abutment elements 5 when the game wheel 2 remains in a certain rotational position and, accordingly marks the respective segment-shaped game board.

As shown in FIGS. 1 and 2, the game wheel 2 can be mounted on a support frame 7, which may have a ground contact surface to be able to place the gaming device freely on the ground. Alternatively, or additionally, however, a wall mounting for the game wheel 2 can also be provided. In this case, instead of the support frame 7 shown, a corresponding wall mounting support is attached on the back of the game wheel 2 or its wheel axis.

As shown in FIGS. 2 and 3, the mounting of the game wheel 2 may comprise a rotatably fixed wheel axis 8, which is mounted in a rotatably fixed manner and is able, for example to be rigidly fastened to the said support frame 7. A rotary bearing 9, for example in the form of a rolling bearing, can be placed on said wheel axis 8 by means of which a rotatable bearing ring 10 is rotatably supported, on which the wheel body of the game wheel 2 is rigidly fastened.

Said bearing ring 10 can advantageously be sleeve-shaped and have a sufficient length to be able to support the game wheel 2 on the wheel axis 8 in a tumble-fixed manner. For this purpose, particularly two roller bearings 11 and 12, spaced apart from one another, can be provided, for example in the form of ball bearings which support the bearing ring 10 to the fixed wheel axis 8, wherein the roller bearings 11 and 12 can be designed as radial bearings.

If necessary, the rotary bearing 9 for the bearing ring 10 can also have one or more axial bearings 3 to be able to absorb axial bearing forces.

As shown in FIGS. 2 and 3, an electrical operable screen 13, which can advantageously be designed as a flat screen, is provided with game wheel 2. For example, the screen 13 may be a plasma screen or an LCD screen. If desired, however other monitors can also be used as screen 13.

In some embodiments, screen 13 is designed as a touch-screen or touch-sensitive screen in order that touching the screen surface and/or approaching the screen surface may control various game wheel functions. For example, a start and/or stop button can be displayed on the screen 13 as a control panel, so that when the screen 13 is touched within the said control panel, the rotary movement of the game wheel 2 can be started and/or stopped and/or decelerated.

Alternatively, or additionally to such a start/stop button, at least one swipe area can also be displayed on the screen 13, wherein the sensor system of the touchscreen detects the direction and/or speed and/or movement distance of a swiping via the swipe area.

A control device which can be connected to the screen 13 can control the direction of rotation and/or the rotational speed of the game wheel 2 as a function of the detected swiping.

The control device may also be connected to a drive (not shown), such as, for example, an electric drive for driving the game wheel 2 and/or a brake for braking the game wheel 2.

Alternatively, or additionally to the representation of such control panels, the rotating movement of the game wheel 2 can also be represented or simulated on the screen 13, for example, in such a way that the game wheel sections concealed by the screen 13 are also shown in a rotating manner, in a similar rotation speed and direction.

As shown in the FIGS. 1, 2 and 3, the screen 13 can be mounted within the visible surface, or circumferential contour, of the game wheel 2 as viewed in the direction of the wheel axis 8. Each side of the screen 13 may be enclosed by a portion of the game wheel 2 so that the screen 13 has no screen portion outside the game wheel 2 at viewing direction parallel to the wheel axis 8.

Particularly, the screen 13 can be superimposed to or otherwise placed in front of the game wheel 2, and can be centered relative to the wheel axis 8 so that an inner, central part of the game wheel 2 is concealed by the screen 13.

As shown in FIG. 3, the screen 13 can be mounted fixed, wherein, for example the fixed wheel axis 8 being guided through the game wheel 2 and the screen 13 being rigidly fastened to the wheel axis 8.

If, however, the game wheel 2 is enclosed by a game wheel housing 4 in the mentioned manner, the said screen 13 can also be attached to a portion of the said game housing 14.

As shown in FIG. 3, a wiring 14, which may comprise, for example a signal line and/or a power supply line, can advantageously be led through the hollow wheel axis 8 to the screen 13. The wheel axis 8 can have a central cable shaft 15, through which the cabling 14 extends through the rotating game wheel 2 being guided from the rear side of the game wheel 2 to the screen 13.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. A gaming device, comprising:

a game wheel rotatably mounted around a wheel axis; and an electrical operable screen mounted within a circumferential contour of the game wheel as viewed from a viewing direction of the wheel axis, wherein the screen is superimposed to the game wheel, concealing a part of a surface of the game wheel, wherein the screen comprises a touchscreen and is connected to a control device to control at least one game wheel function of the game wheel, and wherein the game wheel has a wheel body with a cup-shaped, central deepening, in which the screen is at least partially recessed, and an edge of the wheel body enclosing the deepening, the edge being in a common plane with the screen surface of the screen.

2. The gaming device of claim 1, wherein the screen is mounted completely within the circumferential contour of the game wheel in the viewing direction of the wheel axis and is encircled by the game wheel.

3. The gaming device of claim 1, wherein the screen is mounted centered to the wheel axis.

4. The gaming device of claim 1, wherein the screen is mounted with a visible screen surface displaying a screen display parallel to a circulating plane of the game wheel.

5. The gaming device of claim 1, wherein the screen is mounted rotatably fixed and the game wheel is rotatable relative to the screen.

6. The gaming device of claim 1, wherein the screen is mounted on a fixed bearing element, particularly on a fixed wheel axis, on which the game wheel is rotatably mounted.

7. The gaming device of claim 1, wherein the screen is mounted on a game wheel housing, the game wheel housing at least partially enclosing the game wheel.

8. The gaming device of claim 1, wherein the game wheel further comprises: a plate-shaped wheel body.

9. The gaming device of claim 1, wherein the wheel axis is hollow and a wiring is passed through the wheel axis to the screen.

10. The gaming device of claim 1, wherein a control panel for altering a rotational movement of the game wheel is displayed on the screen.

11. The gaming device of claim 1, wherein the screen comprises at least one swipe area for controlling a rotational movement of the game wheel.

12. The gaming device of claim 11, wherein the swipe area is oriented approximately tangentially to the direction of rotation of a game wheel section located behind the swipe area.

13. The gaming device of claim 11, wherein a swiping detector is associated with the swipe area, and wherein the control device is configured to control a rotational movement of the game wheel as a function of a detected swiping.

* * * * *